US007212162B2

(12) United States Patent
Jung et al.

(10) Patent No.: US 7,212,162 B2
(45) Date of Patent: May 1, 2007

(54) HORN ANTENNA FOR CIRCULAR POLARIZATION USING PLANAR RADIATOR

(75) Inventors: Young-Bae Jung, Daejon (KR); Soon-Ik Jeon, Daejon (KR); Chang-Joo Kim, Daejon (KR)

(73) Assignee: Electronics and Telecommunications Research Institute (KR)

( * ) Notice: Subject to any disclaimer, the term of this patent is extended or adjusted under 35 U.S.C. 154(b) by 33 days.

(21) Appl. No.: 10/994,006

(22) Filed: Nov. 19, 2004

(65) Prior Publication Data

US 2005/0110695 A1 May 26, 2005

(30) Foreign Application Priority Data

Nov. 22, 2003 (KR) ..... 2003-83323

(51) Int. Cl.
*H01Q 1/38* (2006.01)
*H01Q 13/10* (2006.01)

(52) U.S. Cl. ..... 343/700 MS; 343/786; 343/833

(58) Field of Classification Search ..... 343/786, 343/700 MS
See application file for complete search history.

(56) References Cited

U.S. PATENT DOCUMENTS

| | | | | |
|---|---|---|---|---|
| 4,051,476 A | | 9/1977 | Archer et al. | |
| 4,423,422 A | * | 12/1983 | Knop et al. | 343/786 |
| 4,783,663 A | * | 11/1988 | Rammos et al. | 343/778 |
| 5,210,542 A | * | 5/1993 | Pett et al. | 343/700 MS |
| 5,214,394 A | * | 5/1993 | Wong | 330/286 |
| 5,434,581 A | * | 7/1995 | Raguenet et al. | 343/700 MS |
| 5,913,134 A | * | 6/1999 | Drayton et al. | 438/456 |
| 6,281,843 B1 | * | 8/2001 | Evtioushkine et al. | 343/700 MS |
| 6,320,509 B1 | * | 11/2001 | Brady et al. | 340/572.7 |
| 6,762,729 B2 | * | 7/2004 | Egashira | 343/767 |
| 6,788,258 B2 | * | 9/2004 | Olson | 343/700 MS |
| 2003/0063031 A1 | * | 4/2003 | Wong et al. | 343/700 MS |

FOREIGN PATENT DOCUMENTS

| | | | |
|---|---|---|---|
| JP | 54-037556 | | 3/1979 |
| JP | 62-118613 | | 5/1987 |
| JP | 07007320 | * | 1/1995 |
| JP | 2001-168632 | | 6/2001 |
| KR | 100140601 | | 3/1998 |

OTHER PUBLICATIONS

Mikko Sironen, "A 60GHz Conical Horn Antenna with Polarizer Fed by Quasi-Yagi Antenna", 0-7803-7070-8/01/IEEE (pp. 216-219) - 2001.

* cited by examiner

*Primary Examiner*—Trinh Vo Dinh
(74) *Attorney, Agent, or Firm*—Blakely Sokoloff Taylor & Zafman

(57) ABSTRACT

Provided is a horn antenna for circular polarization using a planar radiator. The horn antenna has a simplified and miniaturized structure by substituting a function of a providing signal power to the horn antenna with a function of a circular polarizer which induces circular polarization by using the planar radiator. The horn antenna includes: a horn for radiating signal power; and a planar radiator for providing the signal power to the horn to thereby induce circular polarization, the radiator including a radiating patch.

12 Claims, 5 Drawing Sheets

HORN ANTENNA FOR CIRCULAR POLARIZATION USING PLANAR RADIATOR

FIELD OF THE INVENTION

The present invention relates to a horn antenna for circular polarization using a planar-type radiator; and, more particularly to a horn antenna for circular polarization using a planar-type radiator, the antenna which can be used for an antenna system for satellite communication using circular polarization in a high frequency band or which can be used as an element of an array antenna.

DESCRIPTION OF RELATED ART

Generally, a horn antenna, which is a waveguide antenna, propagates energy through a waveguide by exciting one end of the waveguide and opening the other end to thereby radiate the energy into space through the aperture.

FIG. 1 is a perspective view showing a typical horn antenna for circular polarization.

As shown, the conventional horn antenna has a complicated structure, which includes an exciter for providing signal power to the horn antenna, a circular polarizer 120 for inducing circular polarization, and a waveguide horn 130.

Due to the structural complicacy, it is difficult to design and fabricate the conventional horn antenna and this leads to high production cost.

The structural complicacy also makes the physical size of the horn antenna bigger and thus prohibits it from being applied to various antenna systems using a high-gain array antenna.

In order to solve the problem, U.S. Pat. No. 4,051,476 discloses a horn antenna integrating a small power supplying horn for radiating linear polarization energy and a parabolic radiation horn on a dielectric substrate to thereby reduce a setup space. However, since the horn antenna of the cited patent radiates linear polarization energy, it cannot be applied to the antenna system for circular polarization.

SUMMARY OF THE INVENTION

It is, therefore, an object of the present invention to provide a horn antenna for circular polarization using a planar radiator, the antenna that has a simplified and miniaturized structure by substituting a function of an exciter which provides signal power to the horn antenna with a function of a circular polarizer which induces circular polarization by using the planar radiator.

It is another object of the present invention to provide a wideband high-efficiency antenna that can minimize the narrowband characteristic of the planar radiator and the dielectric loss and radiation loss generated in a high-frequency band by applying a multilayer structure to which a metal plate having an aperture of a predetermined size is inserted in order to improve a narrowband characteristic of the planar radiator.

In accordance with an aspect of the present invention, there is provided a horn antenna for circular polarization, the antenna which includes: a horn for radiating signal power; and a planar radiator for providing the signal power to the horn to thereby induce circular polarization, the radiator including a radiating patch.

In accordance with another aspect of the present invention, the horn antenna further includes: a waveguide section for impedance matching between the planar radiator and the horn, the waveguide being placed between the planar radiator and the horn.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Figure 1:
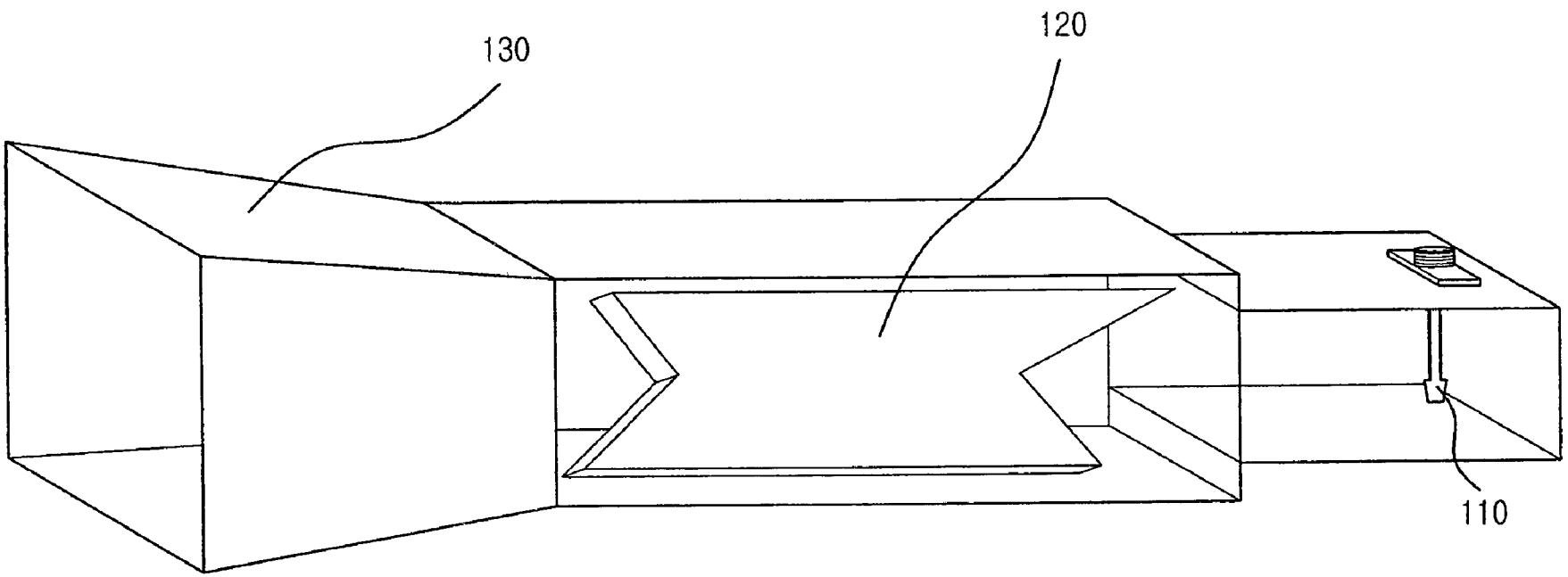
FIG. 1 (PRIOR ART)
FIG. 1 is a perspective view showing a typical horn antenna for circular polarization.
Figure 2:
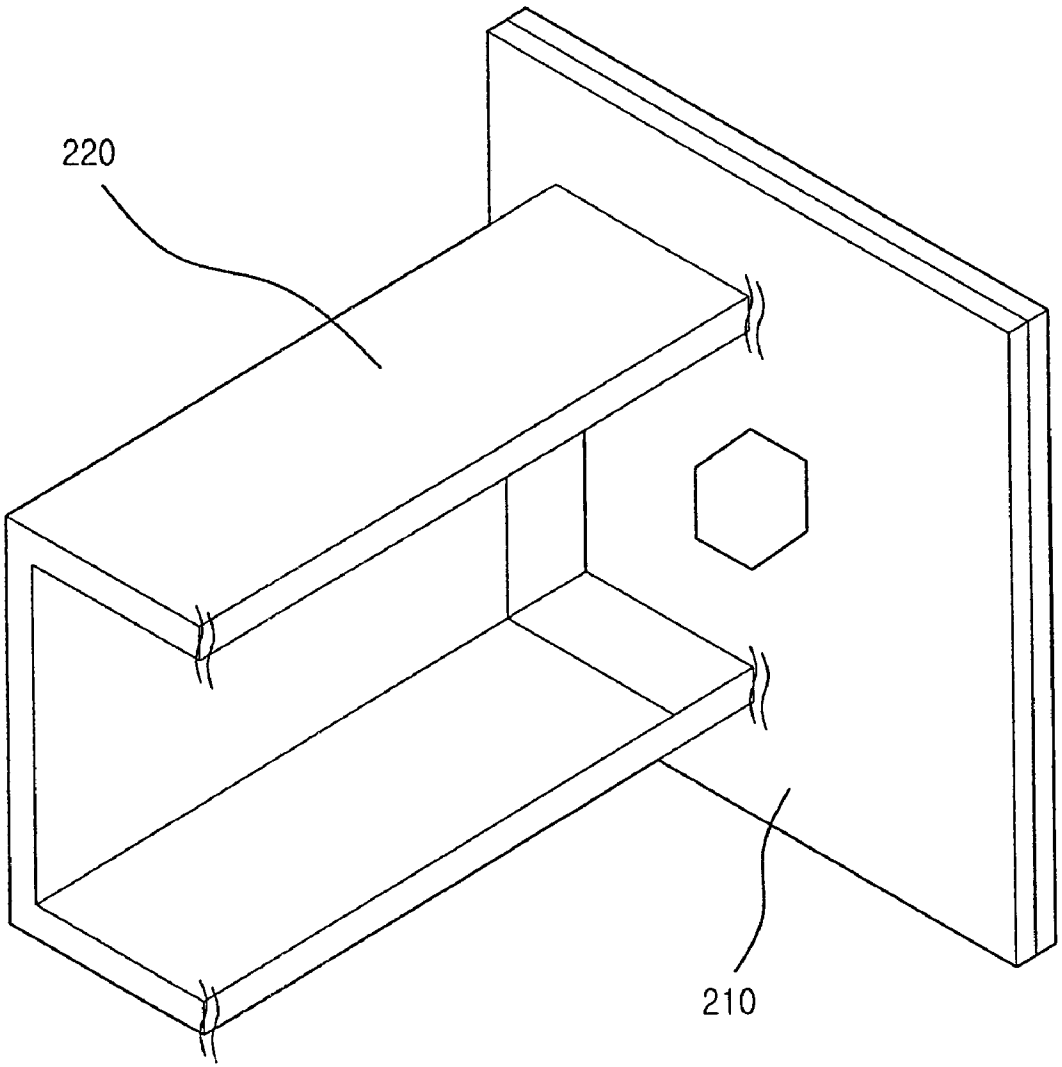
FIG. 2 is a perspective view illustrating a horn antenna for circular polarization using a planar radiator in accordance with an embodiment of the present invention.
Figure 3:
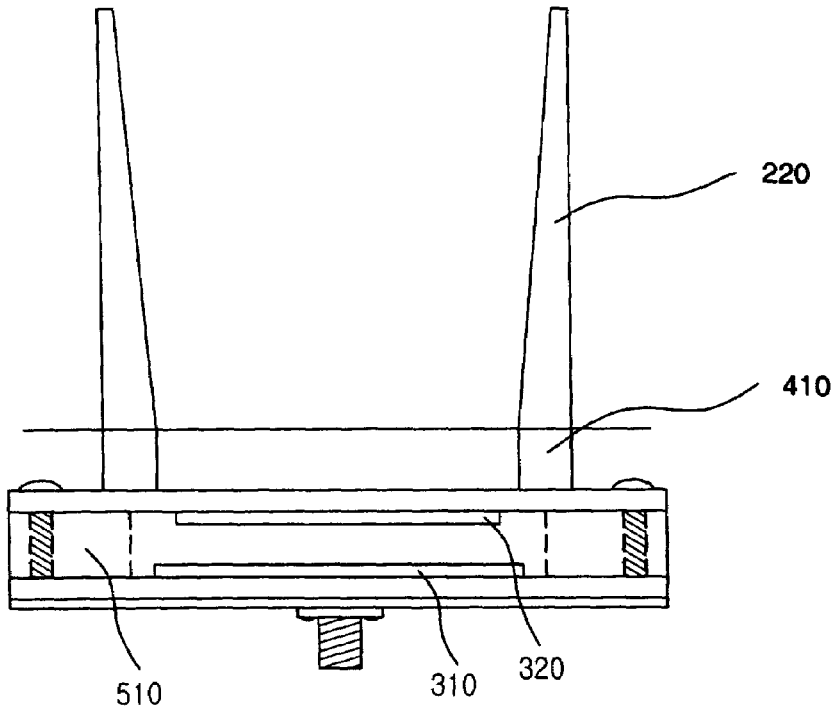
FIG. 3 is a cross-sectional view describing a horn antenna using a planar radiator of FIG. 2 in accordance with an embodiment of the present invention.

FIGS. 2 and 3 present a perspective view and a cross-sectional view illustrating a horn antenna for circular polarization using a planar radiator in accordance with an embodiment of the present invention.

As shown, the horn antenna of the present invention comprises a planar radiator 210 and a horn 220. The drawing presents a cross-section of the horn 220 to describe the planar radiator 210. The complete form of the horn 220 will be described with reference to FIG. 4.

For general understanding, the present invention presents an embodiment where a corner-truncated square patch radiator is applied as the planar radiator 210. However, the present invention is not limited to it and diverse forms of radiating patches can be used.

The planar radiator 210 induces circular polarization as well as providing signal power to the horn 220.

Also, the horn 220 having a square aperture is not connected to the ground of the planar radiator 210 and, thus, there is an additional advantage that the planar radiator 210 can be inserted to and fixed in the inside of the horn 220 conveniently.

Figure 4:
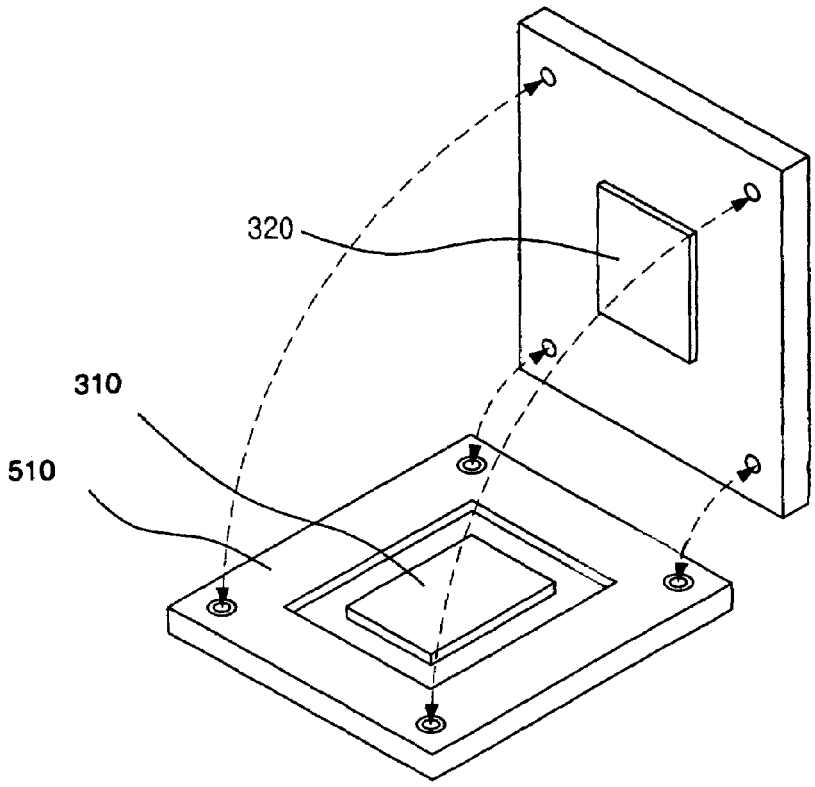
FIG. 4 is a perspective view showing the planar radiator of FIG. 2 in accordance with an embodiment of the present invention.

FIG. 4 shows a structure of the planar radiator of FIGS. 2 and 3.

As shown, the planar radiator 210 has a planar parasitic patch 320 in the upper part of a radiating patch 310 to extend the band of an axial ratio and thereby have a wideband characteristic based on dual resonance. It can have a high-efficiency characteristic by inserting the metal plate having an aperture of a predetermined size between the radiating patch and the parasitic patch to thereby induce the effect of a resonator and growing it.

Other than the examples of the planar radiator of FIGS. 2 and 3, the horn antenna of the present invention can utilize various forms of planar radiators.

Figure 5:
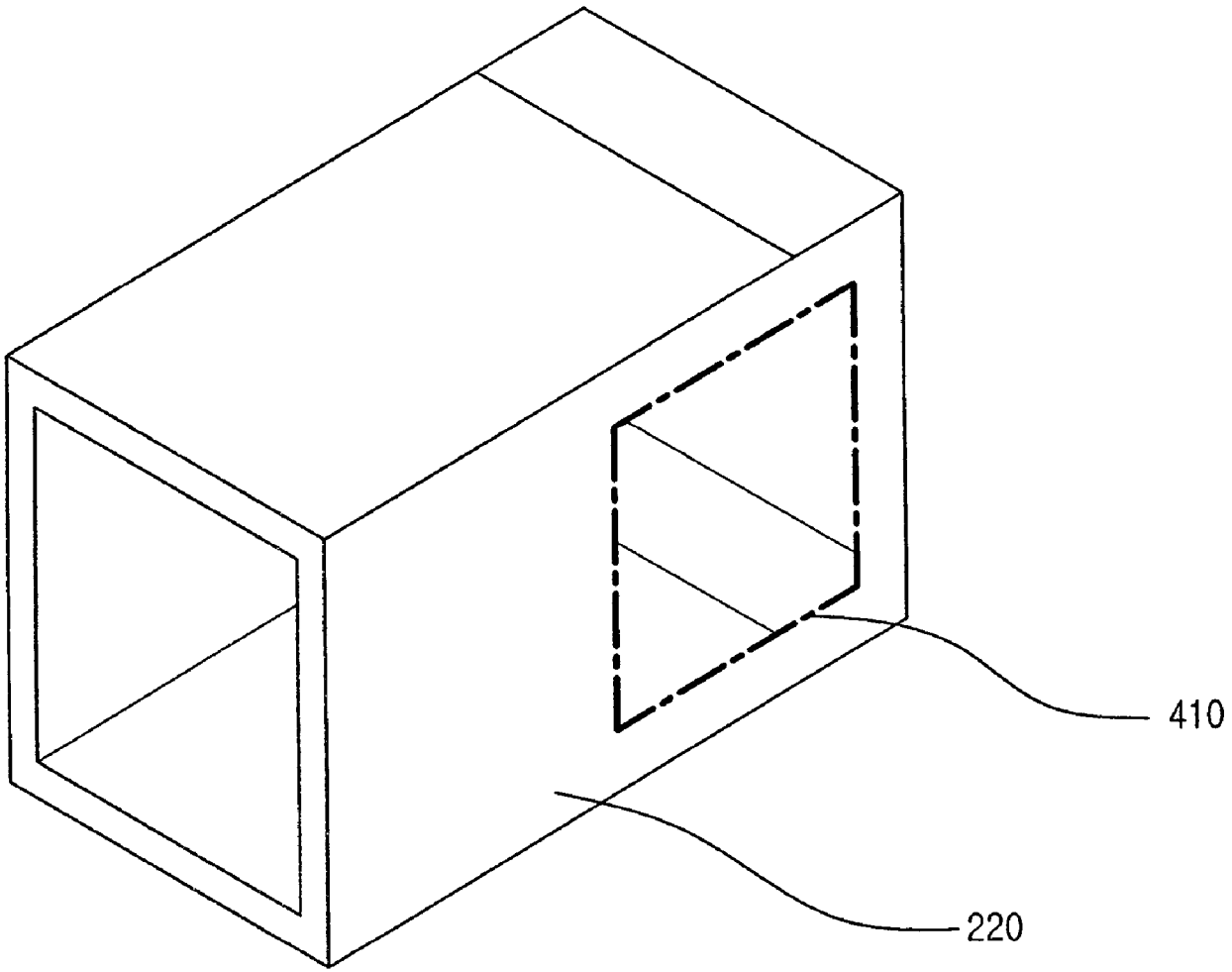
FIG. 5 is a perspective view showing a horn of FIG. 2.

FIG. 5 is a perspective view showing a horn of FIG. 2. As shown, the waveguide horn of the present invention further includes a waveguide section 410 having a square aperture for propagating the signal power of the circular polarization to which signal power is supplied through the planar radiator 210.

The waveguide 410 achieves impedance matching between the planar radiator 210 and the horn 220 having a pyramid-shaped square aperture.

To the end of the waveguide section 410, the horn 220 having a pyramid-shaped square aperture is connected so as to radiate circular polarization power propagating through the waveguide section 410 into free space.

The signal power of the circular polarization excited in the planar radiator 210 can be transmitted to the free space through the horn antenna horn antenna of the present invention efficiently.

Figure 6:
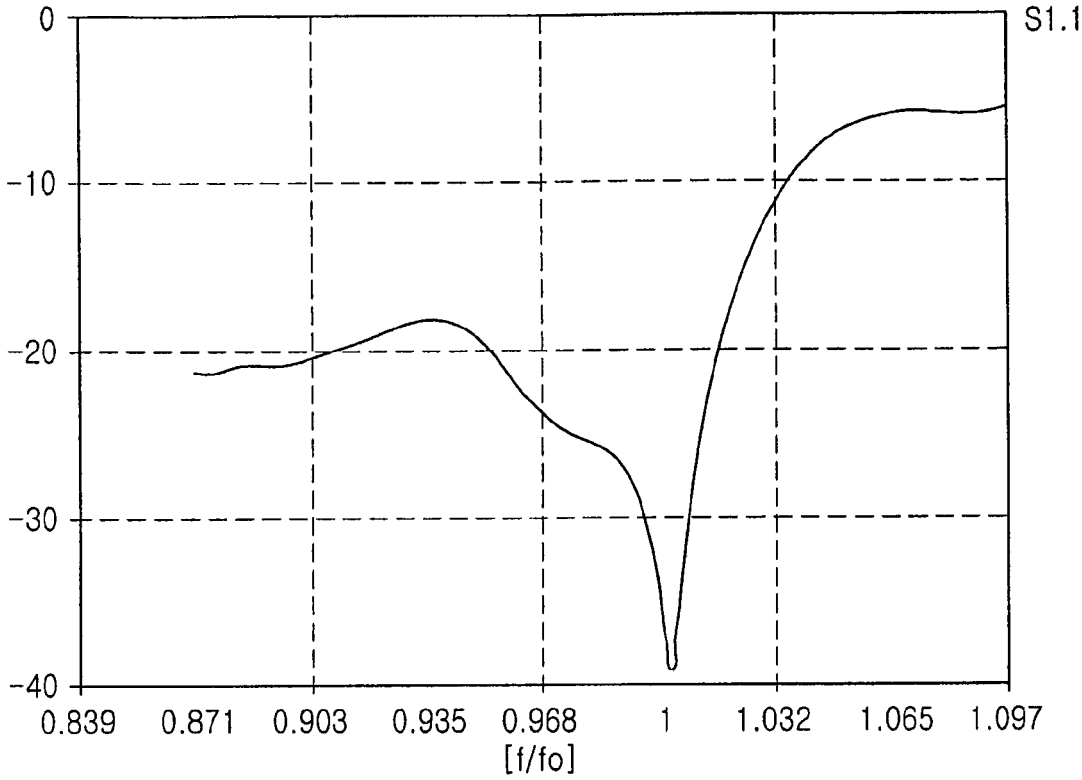
FIG. 6 is a graph describing impedance matching of the horn antenna for circular polarization using the planar radiator in accordance with an embodiment of the present invention.

FIG. 6 is a graph describing impedance bandwidth of the horn antenna for circular polarization using the planar radiator in accordance with an embodiment of the present invention.

As shown, the signal power excited in the planar radiator 210 can be transmitted to the free space efficiently by adjusting the size and length of the square aperture of the horn 220.

Figure 7:
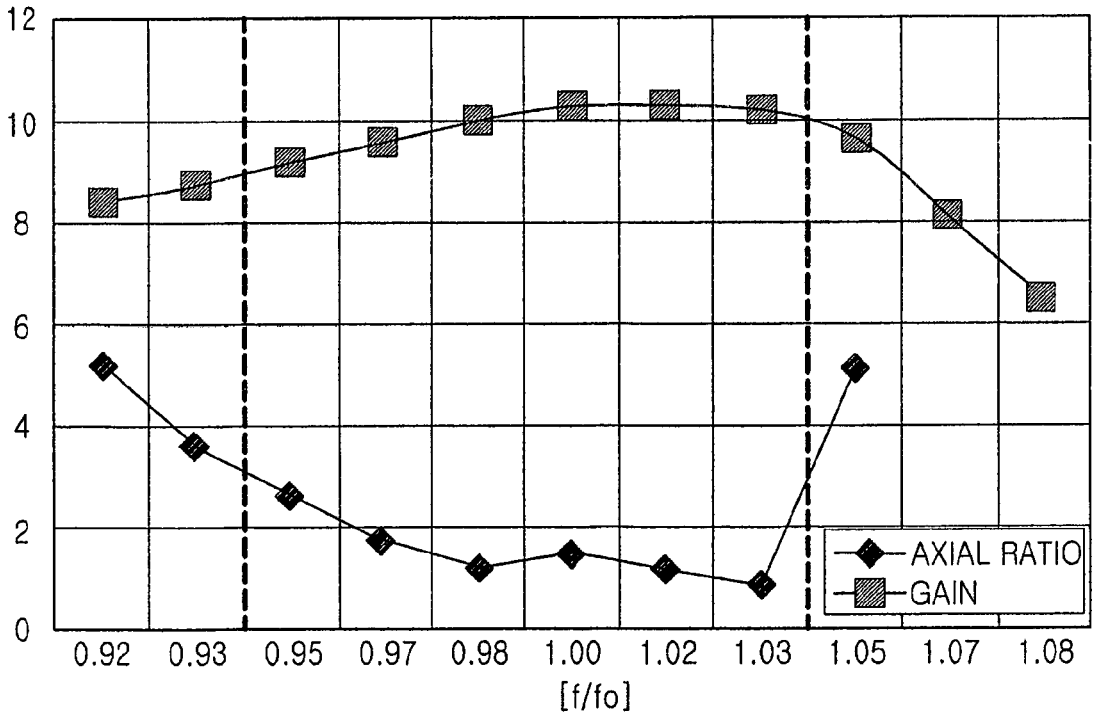
FIG. 7 is a graph describing gain of the horn antenna for circular polarization using the planar radiator and the axial characteristic for circular polarization in accordance with an embodiment of the present invention.

FIG. 7 is a graph describing gain radiator and the axial ratio characteristic of the horn antenna in accordance with an embodiment of the present invention.

As shown, the horn antenna of the present invention has 10% 3 dB axial ratio bandwidth and has at least 9.0 dBi gain characteristic in the same band.

Also, it has 7% 2 dB axial ratio band and has at least 9.5 dBi gain characteristic in the same band.

Since the horn antenna of the present invention has a square structure in which the horizontal and vertical lengths are the same, the horn antenna having a simple structure can generate circular polarization without additional loss.

As described above, the present invention embodies a function of an exciter and a function of a polarizer in the conventional horn antenna for circular polarization simultaneously by applying the planar radiator to the horn antenna for circular polarization.

Also, the technology of the present invention can reduce the size of the horn antenna for circular polarization by removing a circular polarizer which has a considerable size of the conventional horn antenna, and it can reduce the production cost as well as providing convenience in designing.

In addition, it can be applied to a fabrication of a waveguide to form a parallel power supply structure in the waveguide.

It can also include a sort of a resonator effect by inserting a metal plate having an aperture of a predetermined size between the radiating patch and the parasitic patch and thereby provide wideband and high-efficiency characteristics.

The present application contains subject matter related to Korean patent application No. 2003-0083323, filed in the Korean Intellectual Property Office on Nov. 22, 2003, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A horn antenna for circular polarization, comprising:

a horn for radiating signal power;

a planar radiator including a radiating patch for providing the signal power to the horn to thereby induce circular polarization, wherein the radiator has a multilayer structure containing the radiating patch and a parasitic patch; and a metal plate having an aperture surrounding outer edges of the radiating patch and the parasitic patch to improve wideband characteristic and high-efficiency characteristic of the horn antenna, wherein the aperture is uniformly shaped to surround the outer edges of the radiating patch and the parasitic patch.

2. The horn antenna as recited in claim 1, wherein the planar radiator includes a structure that induces circular polarization.

3. The horn antenna as recited in claim 2, wherein an end of the waveguide section is connected to the horn.

4. The horn antenna as recited in claim 1, further comprising:

a waveguide section being placed between the planar radiator and the horn for performing impedance matching on the planar radiator and the horn.

5. The horn antenna as recited in claim 4, wherein the planar radiator includes a structure for inducing circular polarization.

6. The horn antenna as recited in claim 4, wherein the waveguide section is not connected to the ground of the planar radiator.

7. The horn antenna as recited in claim 1, wherein the horn has a pyramid-shaped square aperture.

8. The horn antenna as recited in claim 1, wherein the planar radiator is a corner-truncated square microstrip patch.

9. The horn antenna as recited in claim 8, wherein the aperture of the metal plate has a predetermined size greater than the size of either one of the radiating patch and the parasitic patch, and a predetermined thickness greater than the thickness of the radiating patch and the parasitic patch.

10. The horn antenna as recited in claim 9, wherein the radiator has a structural characteristic that induces circular polarization.

11. The horn antenna as recited in claim 1, wherein the planar radiator includes the parasitic patch in the upper part of the planar radiator to have a wideband characteristic through dual resonance.

12. The horn antenna as recited in claim 1, wherein the horn has a pyramid-shaped square aperture and a constant outer perimeter.

* * * * *